United States Patent [19]

DiMatteo

[11] 4,380,337

[45] Apr. 19, 1983

[54] GOLF BALL POSITION MARKING DEVICE

[76] Inventor: Rocco J. DiMatteo, 3 Brow St., Barrington, R.I. 02806

[21] Appl. No.: 323,222

[22] Filed: Nov. 20, 1981

[51] Int. Cl.[3] ..... A63B 53/14

[52] U.S. Cl. ..... 273/162 D; 40/317

[58] Field of Search ..... 273/162 D, 32 A, 162 R, 273/162 A, 162 B, 162 C, 162 F, 162 E; 40/317, 10 R

[56] References Cited

U.S. PATENT DOCUMENTS

| | | | |
|---|---|---|---|
| 2,261,959 | 11/1941 | Buttikofer | 273/32 A |
| 2,700,547 | 1/1955 | Kraeling | 273/32 A X |
| 4,168,067 | 9/1979 | Wiczer | 273/127 R |

FOREIGN PATENT DOCUMENTS

| | | | |
|---|---|---|---|
| 1043683 | 9/1966 | United Kingdom | 273/162 D |

*Primary Examiner*—George J. Marlo
*Attorney, Agent, or Firm*—Robert J. Doherty

[57] ABSTRACT

A device for marking the location of a golf ball on a putting green including a disc-like marker member which is detachable from a first member which in turn is adapted for connection to the handle grip of a golf club putter. The first member includes a generally flat top from which a narrowed shaft downwardly extends. The shaft terminates in an enlarged generally conical head such that the shaft head can be forced through the narrow central opening of a golf club head end cap so as to firmly position the first member therewith. The top of the first member is thus positioned on the top of the end cap and further includes attachment means for a generally disc-shaped marker. The marker can be repeatedly attached and detached from the first member to permit its intended use on a golf green.

2 Claims, 4 Drawing Figures

GOLF BALL POSITION MARKING DEVICE

BACKGROUND AND OBJECTS OF THE INVENTION

This invention relates to an improved device for marking the location of golf balls on a putting green. It is customary and often necessary to remove one's ball from its precise location on a golf putting green so that another golfer or golfers may complete putting without the possible interference of the removed ball. In such regard, it is common to carry a small thin disc-like device called a marker either in one's pocket or golf bag as a separate item or to utilize in some cases a coin. It is also known to mount such marking devices in a detachable relationship with a portion of a protective golfing glove. Such prior devices however involve the use of a separate piece of equipment other than that which is necessary at the putting green, i.e., a golf club, or involve a separate task, e.g., remembering or carrying a separate marking device.

The present invention solves the above-indicated prior art deficiencies by mounting a marker of the type under consideration on the golfer's putting club and this insures that the marking device will always be conveniently available to the golfer during those times while the putting phase of the golf game is being carried out. This and other objects of the present invention are carried out by the provision of a device including a first member adapted to be removably but somewhat permanently attached to the end cap of the putter's frictional handle grip through the air vent bore projecting therethrough and a second member in the form of a marker element detachably secured to that portion of the first element outwardly projecting from said end cap.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 1:
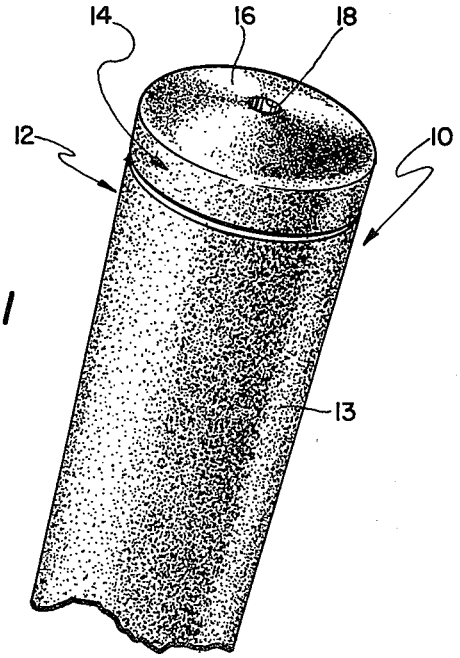
FIG. 1 is a partial perspective view of a golf putter handle grip showing the conventional air vent opening positioned through the end cap portion thereof.
Figure 2:
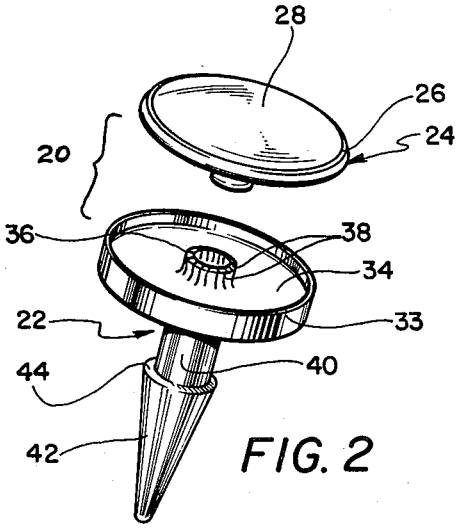
FIG. 2 is a perspective view of the device of the present invention with the marker element thereof separated, that is, detached therefrom.
Figure 3:
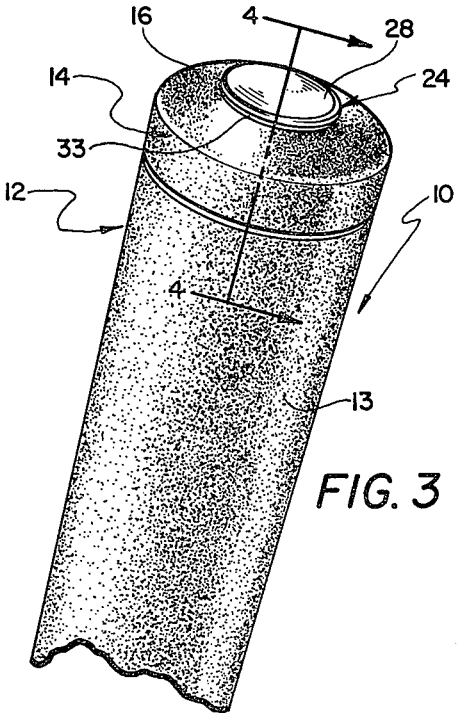
FIG. 3 is a partial perspective view of the golf club shown in FIG. 1 with the device of FIG. 2 mounted thereto and with the marker element engaged therewith.
Figure 4:
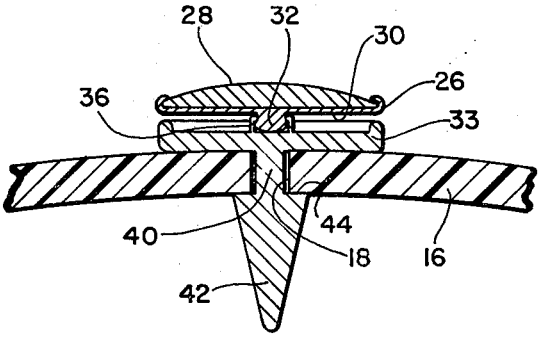
FIG. 4 is a side elevational view taken along the line 4—4 of FIG. 3 and shows in particular the manner in which the device of the present invention is securely mounted to the end cap of the golf putter handle grip.

Turning now to the drawing and in particular the FIG. 1 showing thereof, a handle portion 12 of a golf club, namely a putter 10, is shown. The handle 12 is of conventional design and includes an elongated body 13 of downwardly tapered configuration and formed from an elastomeric material such as rubber-like composition. Such handle 12 forms the grip by which the club is manipulated in the desired manner. The covering 12 includes an end cap 14 also of elastomeric or yieldable material such as a rubber-like composition. The end cap 14 in turn includes an end wall 16 having a bore 18 centrally disposed therethrough. Such bore forms an air vent to facilitate the receipt of the handle portion of the club into the grip through a lower open end (not illustrated).

The device 20 of the present invention is adapted for mounting to the end cap 14 in the manner hereinafter described. The device 20 includes a first member 22 and a second member 24. The second member 24 is preferably of essentially disc-like configuration including a body 26 generally of planar configuration and exhibiting an upper surface 28 and a lower surface 30. The upper surface 28 is generally provided with a bright or otherwise distinctive appearance or color such that the element 26 may be easily distinguished when placed on the grass of the putting green. The undersurface 30 may be also similarly provided with a distinctive appearance. In addition, the undersurface 30 includes a downwardly extending post 32 generally centrally disposed thereof and adapted for snap detachable attachment to an expandible pocket provided on the first member 22 and which cooperatively forms the attachment means by which the marking member 26 may be easily removed and re-affixed in relationship to the first member 22. Also although the element 26 is shown in the drawing as being of two piece construction, it should be apparent that it could be and preferably is made integral, that is, of one piece construction.

The first member 22 includes a substantially planar top portion 33 having the upper surface 34 on which the aforementioned pocket 36 of the detachment means is disposed. Such pocket 36 is in the form of an upwardly extending annular ridge formed from a plurality of slightly spaced segments 38 which provide the frictional "give" so that the post 32 may be snugly received therein in frictional engagement.

A shaft portion 40 downwardly extends from the top portion 33 and terminates in an enlarged lower portion 42. The enlarged lower portion 42 is preferably of conical shape and exhibits an upper surface or shelf 44 of essentially planar configuration and which is adapted to engage the lower surface of the end wall 16 of the grip end cap. In this respect, it should be pointed out that the end wall is formed of an elastomeric material which is yieldable and that the enlarged lower portion of the first member 22 progressively opens the bore 18 until it clears the lower terminus thereof at which time the expanded bore contracts and the shelf 44 is adapted to engage under portions of the end wall 16 so as to securely mount the first member 22 on the end cap 14. In such position the first member can be removed therefrom but preferably with considerable effort as its connection is intended to be of a semipermanent nature, an important aspect being that the force necessary to dislodge the first member 22 from the end cap is substantially greater than the force necessary to remove the marker element 26 from its detachable position with respect to the top portion 33 of such first member 22. In this respect, it should be pointed out that both the marker element 26 and the first attachment portion of the device 20 are formed from a substantially rigid material, i.e., metal, although engineering plastics may be utilized as well.

The outer radial extent of the marker element 26 should be slightly greater than that of the top portion 33 of the first member 22 such that one's fingernail or other object can be conveniently utilized to pry the marker element upwardly and detach it from its post and pocket attachment means. It should also be pointed out that other detachment means than the post and pocket assembly illustrated and described may be utilized to temporarily and conveniently attach the first and second members together in the desired manner, i.e., the upper surface 34 of the top portion 33 may be provided with an adhesive coating whereby the marker element 26 may be firmly but detachably connected thereto. Also such adhesive coating could be provided on the undersurface of the marker element 26 or both cooperating surfaces provided therewith so long as the desired end result were achieved.

It is thus believed that the device of the present invention presents a convenient, simple, yet easily manufactured device which achieves the objects of the present invention in a straightforward and non-obvious manner.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A device for marking the location of a golf ball on a green when such ball is removed for putting, said device adapted for use with a golf putter club of the type having a frictional handle grip of yieldable material covering the upper club end and terminating in a generally solid end cap, said end cap including an end wall having a centrally disposed air vent bore projecting therethrough, said device comprising a substantially rigid, nonyieldable first member having a substantially planar top portion, a shaft portion downwardly extending therefrom and terminating in an enlarged lower portion of an overall conical shape and terminating at its upper end in a generally flat ledge spaced from the lower surface of said top portion a distance equal to or slightly larger than the extent of said end cap air vent bore, said shaft adapted for direct frictional receipt in said bore with said upper ledge surface of said lower portion engaging the lower surface of said end wall and the lower surface of said top portion engaging the upper surface of said end cap end wall so as to positively secure said first member to said golf club grip, said bore adapted to temporarily expand to receive said enlarged lower portion, and a second substantially rigid, disc-shaped member comprising a marker and adapted for removable attachment to said first member, the upper surface of said first member top portion and the marker cooperatively forming attachment means whereby said marker may be secured thereto as in normal play with said club and alternatively detached therefrom when it is desired to utilize the second member as a putting green ball marker said attachment means being of post and pocket construction, said post downwardly extending from the lower surface of said marker and said pocket disposed on the upper surface of said first member top portion whereby said marker is detachably frictionally snap engaged to said first member top portion with a force substantially less than that with which said first member is engaged to said golf club handle grip.

2. The device of claim 1, wherein the outer radial extent of said marker element is slightly greater than that of the top portion of the first member.

* * * * *